US010576749B2

(12) United States Patent
Moriwaki

(10) Patent No.: US 10,576,749 B2
(45) Date of Patent: Mar. 3, 2020

(54) LIQUID CIRCULATION DEVICE AND LIQUID DISCHARGE APPARATUS

(71) Applicant: Yuta Moriwaki, Kanagawa (JP)

(72) Inventor: Yuta Moriwaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/010,939

(22) Filed: Jun. 18, 2018

(65) Prior Publication Data

US 2018/0370245 A1 Dec. 27, 2018

(30) Foreign Application Priority Data

Jun. 27, 2017 (JP) ..... 2017-125047

(51) Int. Cl.

| | |
|---|---|
| ***B41J 2/19*** | (2006.01) |
| ***B41J 2/18*** | (2006.01) |
| ***B41J 2/175*** | (2006.01) |
| ***B41J 2/14*** | (2006.01) |

(52) U.S. Cl.

CPC ..... *B41J 2/18* (2013.01); *B41J 2/14274* (2013.01); *B41J 2/175* (2013.01); *B41J 2/17563* (2013.01); *B41J 2/17596* (2013.01); *B41J 2/19* (2013.01); *B41J 2202/10* (2013.01); *B41J 2202/12* (2013.01)

(58) Field of Classification Search

CPC .... B41J 2/175; B41J 2/17563; B41J 2/17596; B41J 2/18; B41J 2/185; B41J 2/19; B41J 2/195; B41J 2202/12

See application file for complete search history.

(56) References Cited

U.S. PATENT DOCUMENTS

| | | | | |
|---|---|---|---|---|
| 2010/0091055 | A1* | 4/2010 | Kawakami | B41J 2/175 347/9 |
| 2015/0062255 | A1 | 3/2015 | Sasaki | |
| 2015/0314607 | A1* | 11/2015 | Moriguchi | B05B 7/24 347/85 |
| 2016/0129693 | A1 | 5/2016 | Moriwaki et al. | |
| 2016/0185113 | A1 | 6/2016 | Yoshida et al. | |

(Continued)

FOREIGN PATENT DOCUMENTS

| | | |
|---|---|---|
| JP | 2015-071289 | 4/2015 |
| JP | 2016-124191 | 7/2016 |
| JP | 2017-144659 | 8/2017 |

*Primary Examiner* — Scott A Richmond

(74) *Attorney, Agent, or Firm* — Oblon, McClelland, Maier & Neustadt, L.L.P.

(57) ABSTRACT

A liquid circulation device includes a liquid discharge head, a circulation channel through which a liquid is circulated via the liquid discharge head, a first liquid feed pump to supply the liquid to the liquid discharge head in a circulation direction, a second liquid feed pump to collect the liquid from the liquid discharge head in the circulation direction, a filter disposed in the circulation channel upstream from the first liquid feed pump and downstream from the second liquid feed pump in the circulation direction, and a decompression-side reverse channel to bypass the second liquid feed pump. One end of the decompression-side reverse channel is connected to the circulation channel upstream from the second liquid feed pump, and another end of the decompression-side reverse channel is connected to the circulation channel downstream from the filter in the circulation direction.

19 Claims, 10 Drawing Sheets

(56) References Cited

U.S. PATENT DOCUMENTS

| | | | | |
|---|---|---|---|---|
| 2017/0106655 | A1 | 4/2017 | Moriwaki et al. | |
| 2017/0197432 | A1* | 7/2017 | Yamada | B41J 2/18 |
| 2017/0239949 | A1 | 8/2017 | Yoshida | |
| 2017/0297333 | A1 | 10/2017 | Kohda et al. | |
| 2018/0134033 | A1* | 5/2018 | Sawase | B41J 2/175 |
| 2018/0147854 | A1* | 5/2018 | Yoshida | B41J 2/17596 |
| 2018/0170066 | A1* | 6/2018 | Ohtsu | B41J 2/19 |

* cited by examiner

LIQUID CIRCULATION DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-125047, filed on Jun. 27, 2017 in the Japan Patent Office, the entire disclosure of which is hereby incorporated by reference herein.

BACKGROUND

Technical Field

Aspects of this disclosure relate to a liquid circulation device and a liquid discharge apparatus incorporating the liquid circulation device.

Related Art

As a liquid discharge head (hereinafter simply referred to as a "head") for an image forming apparatus, there is a flow-through type head (circulation type head) that includes a supply channel connected to an individual chamber communicating with a nozzle, a discharge channel communicating with the individual chamber, a supply port communicating with the supply channel, and a discharge port communicating with the discharge channel.

The flow-through type head includes a circulation type common chamber in which liquid circulates through the head. The circulation channel includes a supply-side manifold, a discharge-side manifold, a supply tank, a supply pump, a collection tank, a collection pump, and a filter. The supply-side manifold communicates with the supply port of the plurality of heads. The discharge-side manifold communicates with the discharge port of the plurality of heads. The supply pump supplies the liquid to the supply-side manifold from the supply tank. The collection pump decompresses the collection tank to discharge the liquid from the discharge-side manifold to the collection tank. The filter is disposed upstream from the supply pump.

SUMMARY

In an aspect of this disclosure, an improved liquid circulation device includes a liquid discharge head, a circulation channel through which a liquid is circulated via the head, a first liquid feed pump to supply the liquid to the liquid discharge head in a circulation direction, a second liquid feed pump to collect the liquid from the liquid discharge head in the circulation direction, a filter disposed in the circulation channel upstream from the first liquid feed pump and downstream from the second liquid feed pump in the circulation direction, and a decompression-side reverse channel to bypass the second liquid feed pump, wherein one end of the decompression-side reverse channel is connected to the circulation channel upstream from the second liquid feed pump, and another end of the decompression-side reverse channel is connected to the circulation channel downstream from the filter in the circulation direction.

In another aspect of this disclosure, an improved liquid circulation device includes a liquid discharge head, a circulation channel through which a liquid is circulated via the head, a first liquid feed pump to supply the liquid to the liquid discharge head in a circulation direction, a second liquid feed pump to collect the liquid from the liquid discharge head in the circulation direction, a degassing device disposed in the circulation channel upstream from the first liquid feed pump and downstream from the second liquid feed pump in the circulation direction, and a decompression-side reverse channel to bypass the second liquid feed pump, wherein one end of the decompression-side reverse channel is connected to the circulation channel upstream from the second liquid feed pump, and another end of the decompression-side reverse channel is connected to the circulation channel downstream from the degassing device in the circulation direction.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
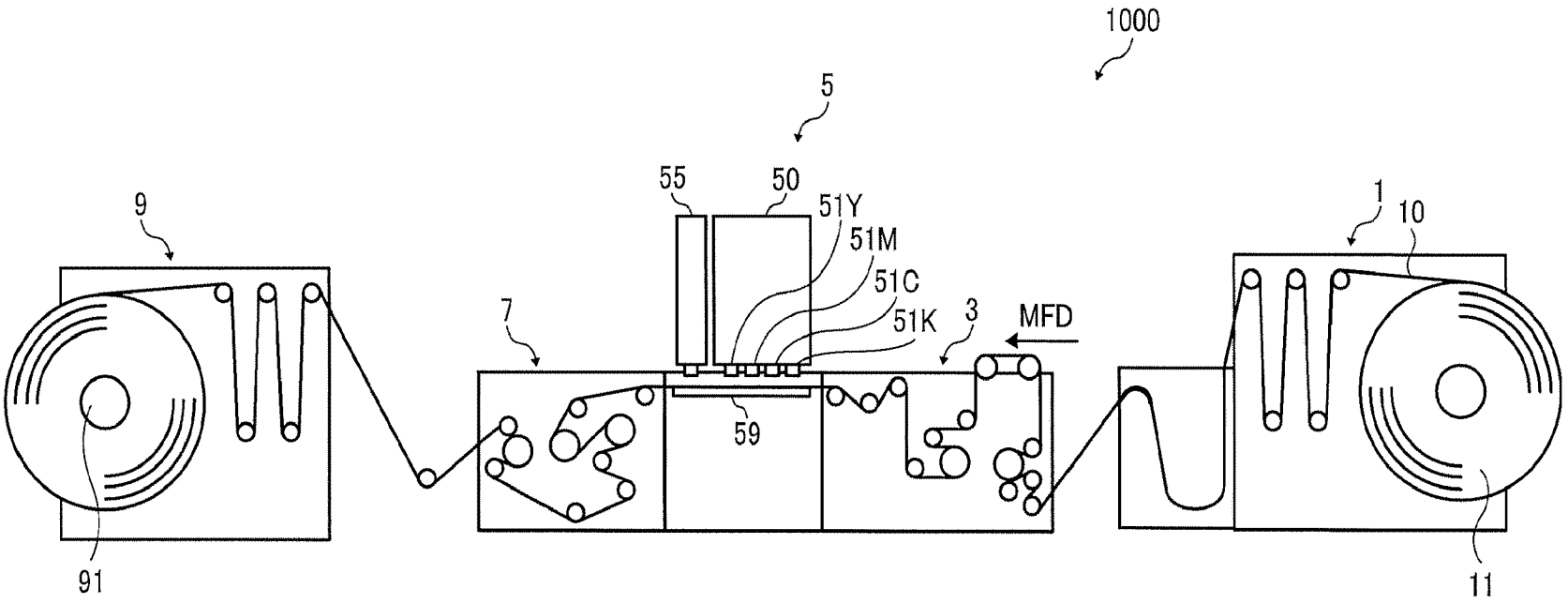
FIG. 1 is a schematic front view of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, embodiments of the present disclosure are described below wherein like reference numerals designate identical or corresponding parts throughout the several views.

An example of a liquid discharge apparatus 1000 according to a first embodiment of the present disclosure is described in detail below with reference to FIGS. 1 and 2.

FIG. 1 is a schematic front view of the liquid discharge apparatus 1000. FIG. 2 is a plan view of a head unit 50 of the liquid discharge apparatus 1000 of FIG. 1. The liquid discharge apparatus 1000 is a printer that forms an image on a continuous medium 10 by discharging a liquid onto the continuous medium 10.

The liquid discharge apparatus 1000 according to the present embodiment includes a feeder 1 to feed the continuous medium 10, a guide conveyor 3 to guide and convey the continuous medium 10, fed from the feeder 1, to a printing unit 5, the printing unit 5 to discharge liquid onto the continuous medium 10 to form an image on the continuous medium 10, a dryer 7 to dry the continuous medium 10, and an ejector 9 to eject the continuous medium 10.

The continuous medium 10 is fed from a winding roller 11 of the feeder 1, guided and conveyed with rollers of the feeder 1, the guide conveyor 3, the dryer 7, and the ejector 9, and wound around a winding roller 91 of the ejector 9.

In the printing unit 5, the continuous medium 10 is conveyed opposite a first head unit 50 and a second head unit 55 on a conveyance guide 59. The first head unit 50 discharges liquid to form an image on the continuous medium 10. Post-treatment is performed on the continuous medium 10 with treatment liquid discharged from the second head unit 55.

Here, the first head unit 50 includes, for example, four-color full-line head arrays 51K, 51C, 51M, and 51Y (hereinafter, collectively referred to as "head arrays 51" unless colors are distinguished) from an upstream side in a feed direction of the continuous medium 10 (hereinafter, "medium feed direction") indicated by arrow MED in FIG. 1.

The head arrays 51K, 51C, 51M, and 51Y are liquid dischargers to discharge liquid of black (K), cyan (C), magenta (M), and yellow (Y) onto the continuous medium 10 conveyed along the conveyance guide 59. Note that the number and types of color are not limited to the above-described four colors of K, C, M, and Y and may be any other suitable number and types.

Figure 2:
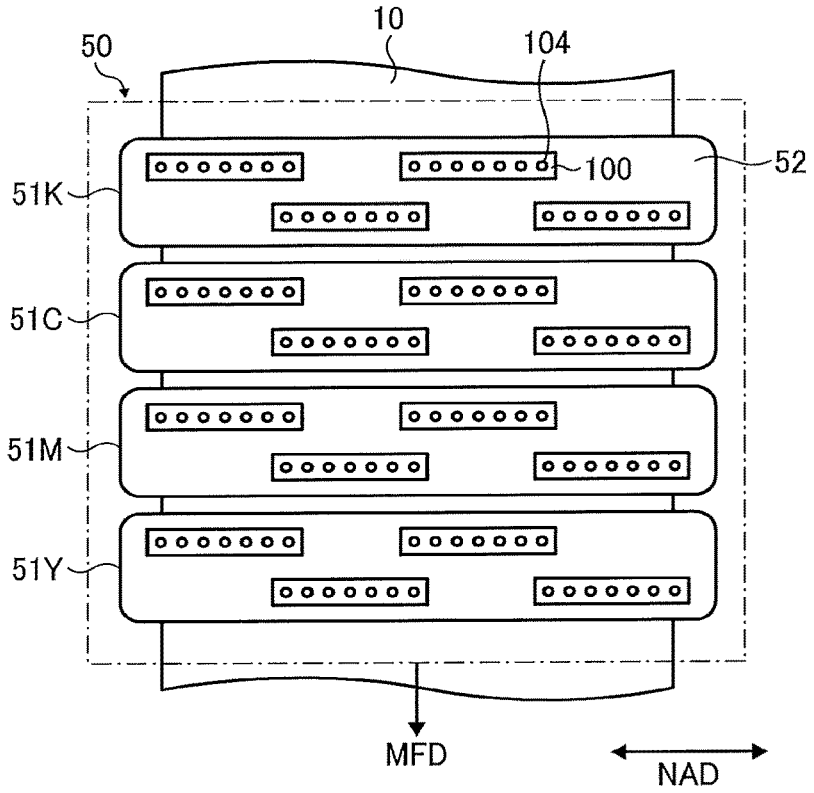
FIG. 2 is a plan view of a head unit of the liquid discharge apparatus of FIG. 1.

In each head array 51, for example, as illustrated in FIG. 2, a plurality of heads 100 is arranged in a staggered manner on a base 52 to form the head array 51. Note that the configuration of the head array 51 is not limited to the configuration illustrated in FIG. 2.

Figure 3:
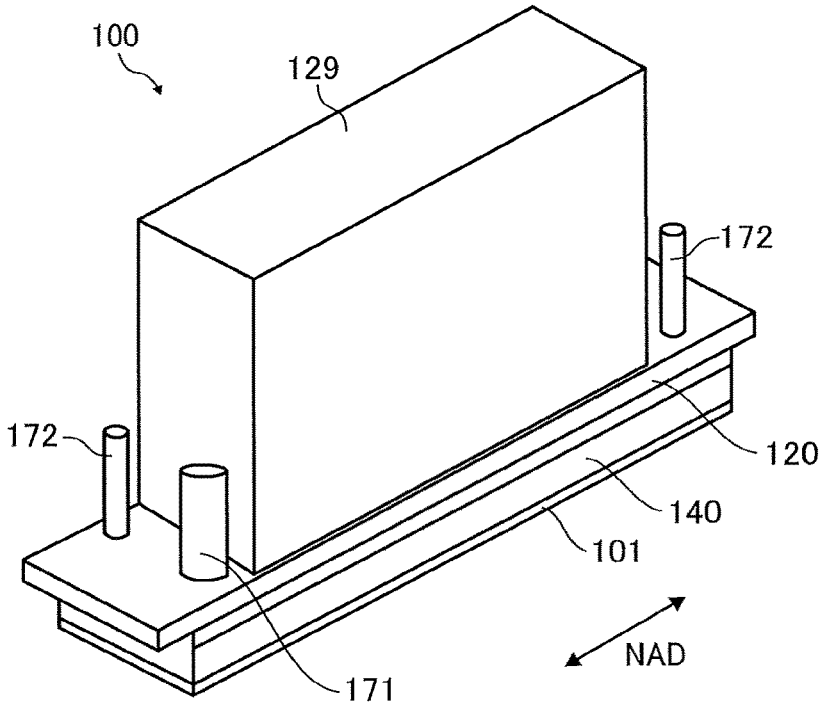
FIG. 3 is a perspective view of the exterior of a liquid discharge head according to a present embodiment.
Figure 4:
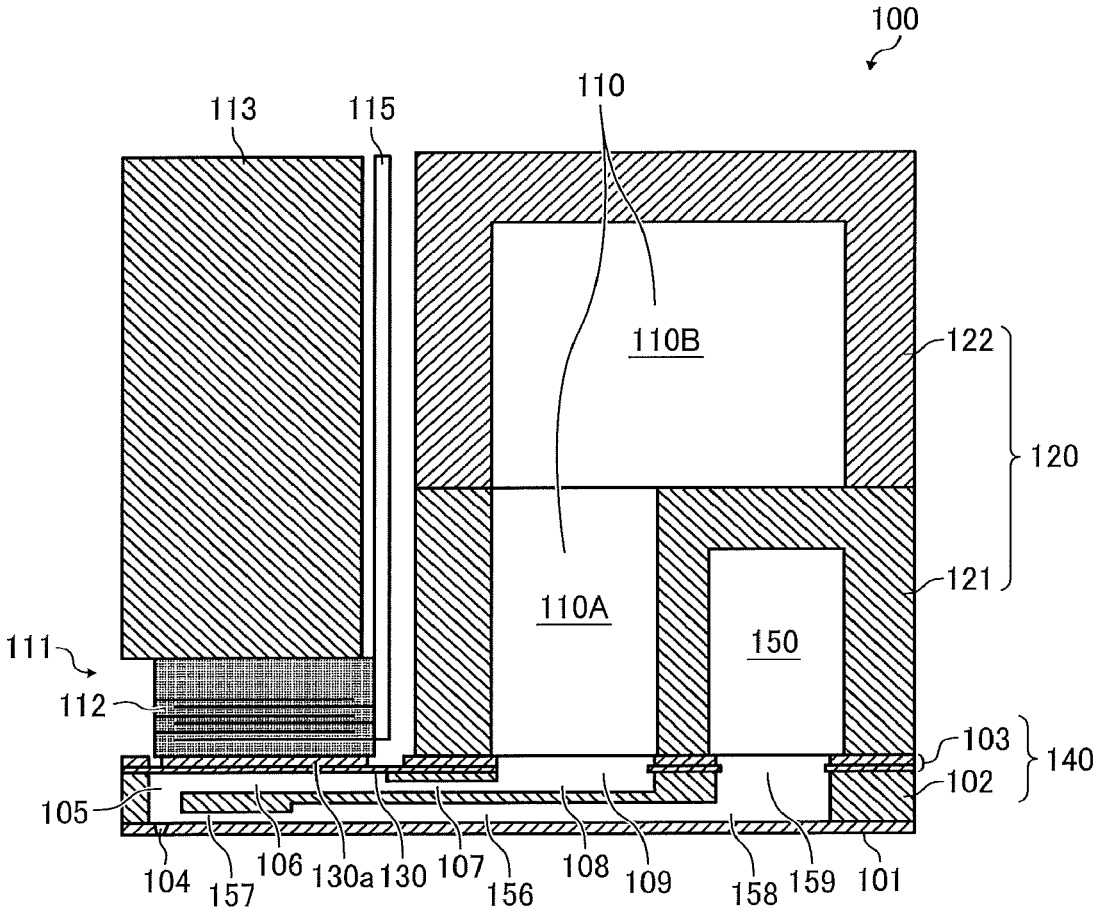
FIG. 4 is a cross-sectional view of the head in a direction perpendicular to a nozzle array direction in which nozzles are arrayed in a row (a longitudinal direction of an individual chamber)

An example of the head 100 according to an embodiment of the present disclosure is described with reference to FIGS. 3 and 4. FIG. 3 is a perspective view of the exterior of the head 100. FIG. 4 is a cross-sectional view of the head 100 in a direction perpendicular to a nozzle array direction in which nozzles 104 are arrayed in a row (a longitudinal direction of an individual chamber 106).

The head 100 includes a nozzle plate 101, a channel substrate 102, and a diaphragm 103 that forms one wall, laminated one on another and bonded to each other. The head 100 includes piezoelectric actuators 111 to displace vibration portion 130 of the diaphragm 103, a common chamber substrate 120 also serving as a frame member of the head 100, and a cover 129. The channel substrate 102 and the diaphragm 103 constitute a channel member 140. The nozzle plate 101 includes multiple nozzles 104 to discharge liquid.

The channel substrate 102 includes through-holes and grooves that form individual chambers 106, supply-side fluid restrictors 107, and supply-side introduction portions 108. The individual chambers 106 communicate with the nozzles 104 via the nozzle communication channels 105, respectively. The supply-side fluid restrictors 107 communicate with the individual chambers 106, respectively. The supply-side introduction portions 108 communicate with the supply-side fluid restrictors 107, respectively. The nozzle communication channels 105 communicate with the corresponding nozzles 104 and the individual chambers 106, respectively. The supply-side introduction portion 108 communicates with the supply-side common chamber 110 via the supply-side opening 109 provided in the diaphragm 103.

The diaphragm 103 includes a deformable vibration portion 130 constituting one wall of the individual chambers 106 of the channel substrate 102. In the present embodiment, the diaphragm 103 has a two-layer structure including a first layer consisting of thin portions and facing the channel substrate 102 and a second layer consisting of thick portions. The first layer includes the deformable vibration portion 130 at positions corresponding to the individual chambers 106. Note that the diaphragm 103 is not limited to the two-layer structure and thus the number of layers may be any other suitable number.

On the opposite side of the individual chamber 106 of the diaphragm 103, there is arranged the piezoelectric actuator 111 including an electromechanical transducer element as a driver (e.g., actuator, pressure generator) to deform the deformable vibration portion 130 of the diaphragm 103.

The piezoelectric actuator 111 includes piezoelectric elements 112 bonded on a base 113. The piezoelectric elements 112 are groove-processed by half-cut dicing so that e a desired number of pillar-shaped piezoelectric elements 112 is arranged at certain intervals, in the shape of a comb.

The piezoelectric element 112 is joined to a convex portion 130*a*, which is a thick portion forming an island on the vibration portion 130 of the diaphragm 103. In addition, a flexible printed circuit (FPC) 115 is connected to the piezoelectric elements 112.

The common chamber substrate 120 includes a supply-side common chamber 110 and a discharge-side common chamber 150. The supply-side common chamber 110 communicates with supply ports 171. The discharge-side common chamber 150 communicates with the discharge ports 172 (See FIG. 3).

The common chamber substrate 120 includes a first common chamber substrate 121 and a second common chamber substrate 122. The first common chamber substrate 121 is bonded to the diaphragm 103 of the channel member 140. The second common chamber substrate 122 is laminated on and bonded to the first common chamber substrate 121.

The first common chamber substrate 121 includes a downstream common chamber 110A and the discharge-side common chamber 150. The downstream common chamber 110A is part of the supply-side common chamber 110 and is communicable with the supply-side introduction portion 108. The discharge-side common chamber 150 communicates with a discharge-side individual channel 156. The second common chamber substrate 122 includes an upstream common chamber 110B that is a remaining portion of the supply-side common chamber 110.

The channel substrate 102 includes discharge-side fluid restrictors 157, discharge-side individual channels 156, and discharge-side introduction portions 158. The discharge-side fluid restrictors 157 communicate with the individual chamber 106 via the nozzle communication channels 105, respectively.

The discharge-side introduction portions 158 communicate with the discharge-side common chamber 150 via discharge-side openings 159 provided in the diaphragm 103.

In the present embodiment, a supply channel is constituted by the supply-side common chamber 110, the supply-side openings 109, the supply-side introduction portions 108, and the supply-side fluid restrictors 107. A discharge channel is constituted by the discharge-side fluid restrictor 157, the discharge-side individual channel 156, the discharge-side introduction portion 158, and the discharge-side opening 159.

In the head 100 thus configured, for example, when a voltage lower than a reference potential (intermediate potential) is applied to the piezoelectric element 112, the piezoelectric element 112 contracts. Accordingly, the vibration portion 130 of the diaphragm 103 is pulled to increase the volume of the individual chamber 106, thus causing liquid to flow into the individual chamber 106.

When the voltage applied to the piezoelectric element 112 is raised above the reference potential, the piezoelectric element 112 expands. Accordingly, the vibration portion 130 of the diaphragm 103 deforms in a direction toward the nozzle 104 and the volume of the individual chamber 106 decreases. Thus, liquid in the individual chamber 106 is discharged from the nozzle 104.

Liquid not discharged from the nozzles 104 passes by the nozzles 104, and is discharged from the discharge-side fluid restrictor 157 to the discharge-side common chamber 150 via the discharge-side individual channel 156, the discharge-side introduction portion 158, and the discharge-side opening 159. The liquid is supplied from the discharge-side common chamber 150 to the supply-side common chamber 110 again through an external circulation path.

Even when the liquid discharge operation for discharging the liquid from the nozzle 104 is not performed, the liquid is discharged from the supply-side common chamber 110 to the discharge-side common chamber 150 via the supply-side opening 109, the supply-side introduction portion 108, the supply-side fluid restrictor 107, the individual chamber 106, the discharge-side fluid restrictor 157, the discharge-side individual channel 156, the discharge-side introduction portion 158, and the discharge-side opening 159. The liquid is supplied from the discharge-side common chamber 150 to the supply-side common chamber 110 again through an external circulation path.

Note that the driving method of the head 100 is not limited to the above-described example (i.e., pull-push discharge). For example, pull discharge or push discharge may be performed depending on the drive waveform.

Figure 5:
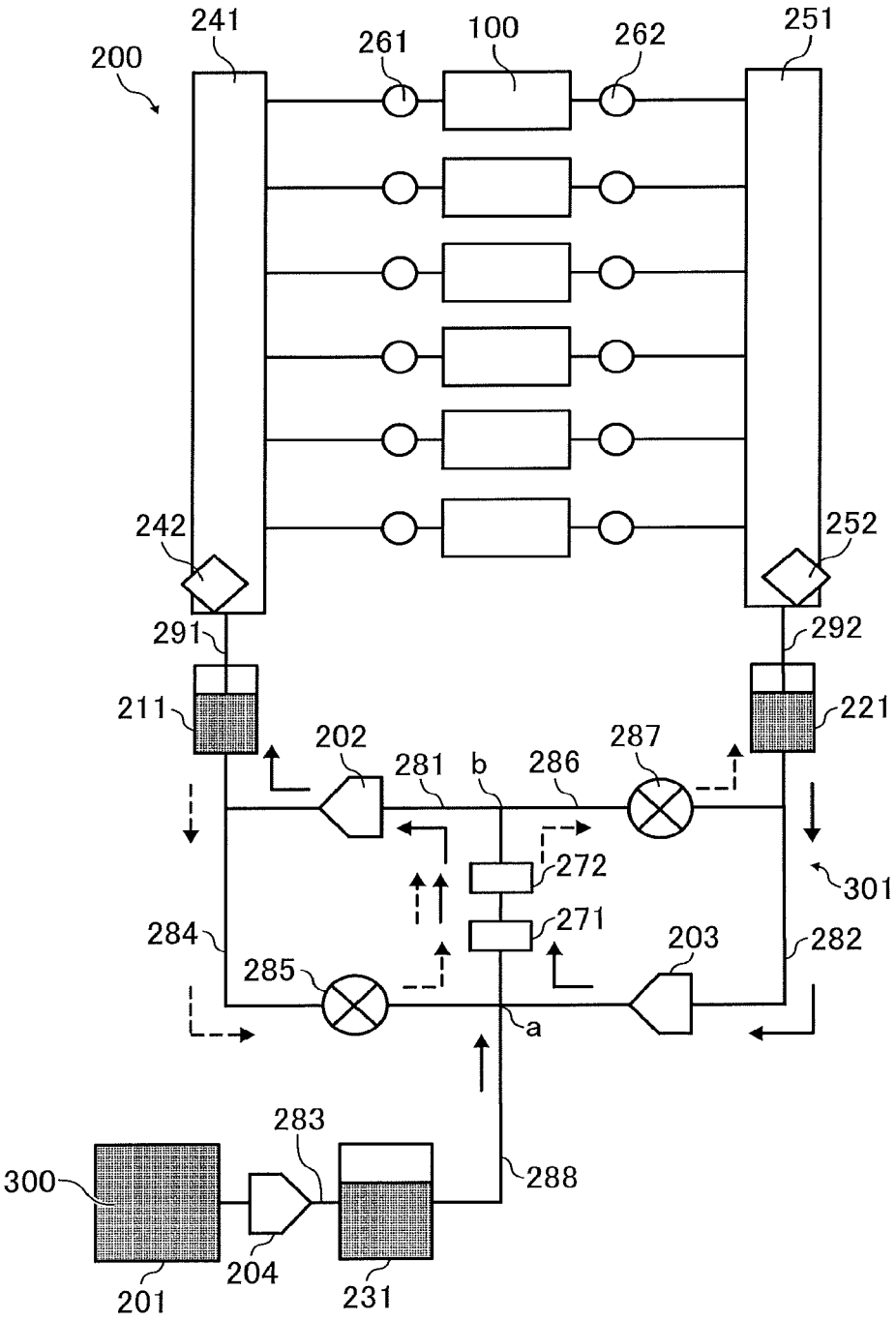
FIG. 5 is an explanatory block diagram of a liquid circulation device according to a first embodiment of the present disclosure.

A first embodiment of the present disclosure is described in detail below with reference to FIG. 5. FIG. 5 is a block diagram of the liquid circulation device (liquid supply device) according to the first embodiment.

The liquid circulation device 200 also serving as a liquid supply device includes a main tank 201 which is a liquid storage for storing the liquid 300 discharged from the head 100, a third sub tank 231 which is connected to a circulation channel 301, and a third liquid feed pump 204 for feeding the liquid from the main tank 201 to the third sub tank 231 via the liquid channel 283.

In the circulation channel 301, there is a first sub tank 211, a second sub tank 221, a first liquid feed pump 202 as a first liquid feeder, a second liquid feed pump 203 as a second liquid feeder, a first manifold 241, and a second manifold 251.

The first sub tank 211 and the first manifold 241 are connected via a liquid channel 291. The first manifold 241 communicates with each of the supply ports 171 of the plurality of heads 100 via compression dampers 261. The first manifold 241 includes a compression-side pressure sensor 242 as a detector for detecting the compression-side pressure.

The second sub tank 221 and the second manifold 251 are connected via a liquid channel 292. The second manifold 251 communicates with each of the discharge ports 172 of the plurality of heads 100 via the decompression damper 262. The second manifold 251 includes a decompression-side pressure sensor 252 as a detector for detecting the decompression-side pressure.

The first liquid feed pump 202 is disposed in a liquid channel 281 that connects the first sub tank 211 and a common liquid channel 288 that is connected to the third sub tank 231. The first liquid feed pump 202 feed the liquid from the third sub tank 231 toward the first sub tank 211 disposed on the head 100 side in a normal circulation direction indicated by solid arrow in FIG. 5. A direction of the normal circulation is also referred to as "a circulation direction". Thus, the liquid is pressurized and is fed from the first sub tank 211 to the first manifold 241.

The second liquid feed pump 203 is disposed in a liquid channel 282 that connects the second sub tank 221 and the common liquid channel 288 that is connected to the third sub tank 231. The second liquid feed pump 203 feeds the liquid to collect the liquid from the second sub tank 221 in the normal circulation direction (circulation direction). Thus, the liquid is collected (discharged) from the second manifold 251 to the decompressed second sub tank 221.

The liquid circulation device 200 includes a filter 271 for removing foreign matter in the liquid channel 281 and a degassing device 272 for removing dissolved gas on the liquid channel 281.

Hereinafter, the expressions "upstream" and "downstream" refer to upstream or downstream in a direction of the liquid flow in a normal circulation in the circulation channel 301. The direction of the liquid flow in a normal circulation in the circulation channel 301 (circulation direction) is indicated by solid-line arrow illustrated in vicinity of the first liquid feed pump 202 and the second liquid feed pump 203 in FIG. 5.

A node "a" in FIG. 5 refers to a connecting portion of the common liquid channel 288 and the liquid channel 281 and 282. The common liquid channel 288 communicates with the third sub tank 231. The liquid channel 281 and the liquid channel 282 downstream from the second liquid feed pump 203 are connected at the node "a". The node "a" is disposed upstream from the filter 271 and the degassing device 272 in the direction of the liquid flow in the normal circulation (circulation direction) indicated by the arrow of the solid line.

Thus, the liquid is collected at the second sub tank 221 by the second liquid feed pump 203, the foreign substances are again removed by the filter 271, and the liquid is degassed by the degassing device 272. Then, the liquid is fed to the first sub tank 211 by the first liquid feed pump 202 to be circulated in the circulation channel 301.

Further, the liquid circulation device 200 includes a compression-side reverse channel 284 that bypasses the first liquid feed pump 202. The compression-side reverse channel 284 is connected to the liquid channel 281 and the common liquid channel 288. The liquid circulation device 200 includes a solenoid valve 285, which is a compression-side valve for opening and closing the compression-side reverse channel 284. One end of the compression-side reverse channel 284 is connected the liquid channel 281 downstream from the first liquid feed pump 202, and another end of the compression-side reverse channel 284 is connected to the liquid channel 281 upstream from the filter 271 and the degassing device 272.

In other words, the compression-side reverse channel 284 is connected to a node that connects the first liquid feed pump 202 and the first sub tank 211. Another end of the compression-side reverse channel 284 is connected to the node "a". The liquid channels 281 and 282 are connected at the node "a".

Further, the liquid circulation device 200 includes a decompression-side reverse channel 286 that bypasses the second liquid feed pump 203. The decompression-side reverse channel 286 is connected to the liquid channels 281 and 282. The liquid circulation device 200 includes a solenoid valve 287 on the decompression-side reverse channel 286. The solenoid valve 287 is a decompression-side valve for opening and closing the decompression-side reverse channel 286. One end of the decompression-side reverse channel 286 is connected to the liquid channel 282 upstream from the second liquid feed pump 203. Another end of the decompression-side reverse channel 286 is connected to the liquid channel 281 downstream from the filter 271 and the degassing device 272.

In other words, one end of the decompression-side reverse channel 286 is connected a node that connects the second liquid feed pump 203 and the second sub tank 221. Another end of the decompression-side reverse channel 286 is connected to the liquid channel 281 at a node "b". In the present embodiment, the node "b" is disposed in the liquid channel 281 between the degassing device 272 and the first liquid feed pump 202. Thus, the another end of the decompression-side reverse channel 286 is connected at a node "b" of the liquid channel 281 between the degassing device 272 and the first liquid feed pump 202.

Directions of the reverse flow (backflow) in the compression-side reverse channel 284 and the decompression-side reverse channel 286 are the direction indicated by broken-line arrow. A direction of the reverse (backflow) flow in a backflow circulation process is also referred to as the "second direction".

Next, a liquid circulation method in the liquid circulation device 200 (liquid supply apparatus) in the present disclosure is described.

The liquid 300 stored in the main tank 201 is sent to the third sub tank 231 by the third liquid feed pump 204 based on the readings from the liquid detector that detects the liquid level in the third sub tank 231.

The first sub tank 211 is pressurized by the liquid feed by the first liquid feed pump 202, and the second sub tank 221 is depressurized by the liquid feed by the second liquid feed pump 203. Thus, a differential pressure is generated between the first sub tank 211 and the second sub tank 221.

Due to this pressure difference, the liquid flows from the first sub tank 211 to the first sub tank 211 through the first manifold 241, the compression damper 261, the head 100, the decompression damper 262, the second manifold 251, and the second sub tank 221 in the circulation channel 301.

The first sub tank 211 is pressurized to a target pressure by the first liquid feed pump 202 based on information of a pressure detection from the compression-side pressure sensor 242. When a value of a pressure detected by the compression-side pressure sensor 242 becomes lower than a set threshold value, the first liquid feed pump 202 feeds the liquid from the third sub tank 231 to the first sub tank 211.

The second sub tank 221 is depressurized to the target pressure by the second liquid feed pump 203 based on the pressure detection information of the decompression-side pressure sensor 252. When a value of a pressure detected by the decompression-side pressure sensor 252 becomes higher than a set threshold value, the second liquid feed pump 203 feeds the liquid from the second sub tank 221 to the third sub tank 231.

When the liquid flows from the first sub tank 211 to the second sub tank 221 due to the pressure difference, the pressure in the first sub tank 211 decreases. Then, the compression-side pressure sensor 242 detects a decrease in the pressure of the first sub tank 211, and the first liquid feed pump 202 operates to refill the first sub tank 211 with the liquid from the third sub tank 231 to pressurize the first sub tank 211.

Similarly, when the liquid flows from the first sub tank 211 to the second sub tank 221 due to the pressure difference, the pressure of the second sub tank 221 increases (negative pressure decreases). The decompression-side pressure sensor 252 detects an increase in the pressure of the second sub tank 221, and the second liquid feed pump 203 operates to discharge the liquid from the second sub tank 221 to the third sub tank 231 to reduce the pressure in the second sub tank 221.

Here, when the liquid is not consumed by a discharge operation of the head 100 or the like, the volume of liquid in the third sub tank 231 does not change significantly.

On the other hand, when the liquid is consumed by the discharge operation of the head 100 or the like, the volume of liquid in the third sub tank 231 decreases. Thus, the decrease in the volume of liquid in the third sub tank 231 is detected by a liquid sensor or the like. Then, the third liquid feed pump 204 refills the third sub tank 231 with the liquid from the main tank 201.

Figure 6:
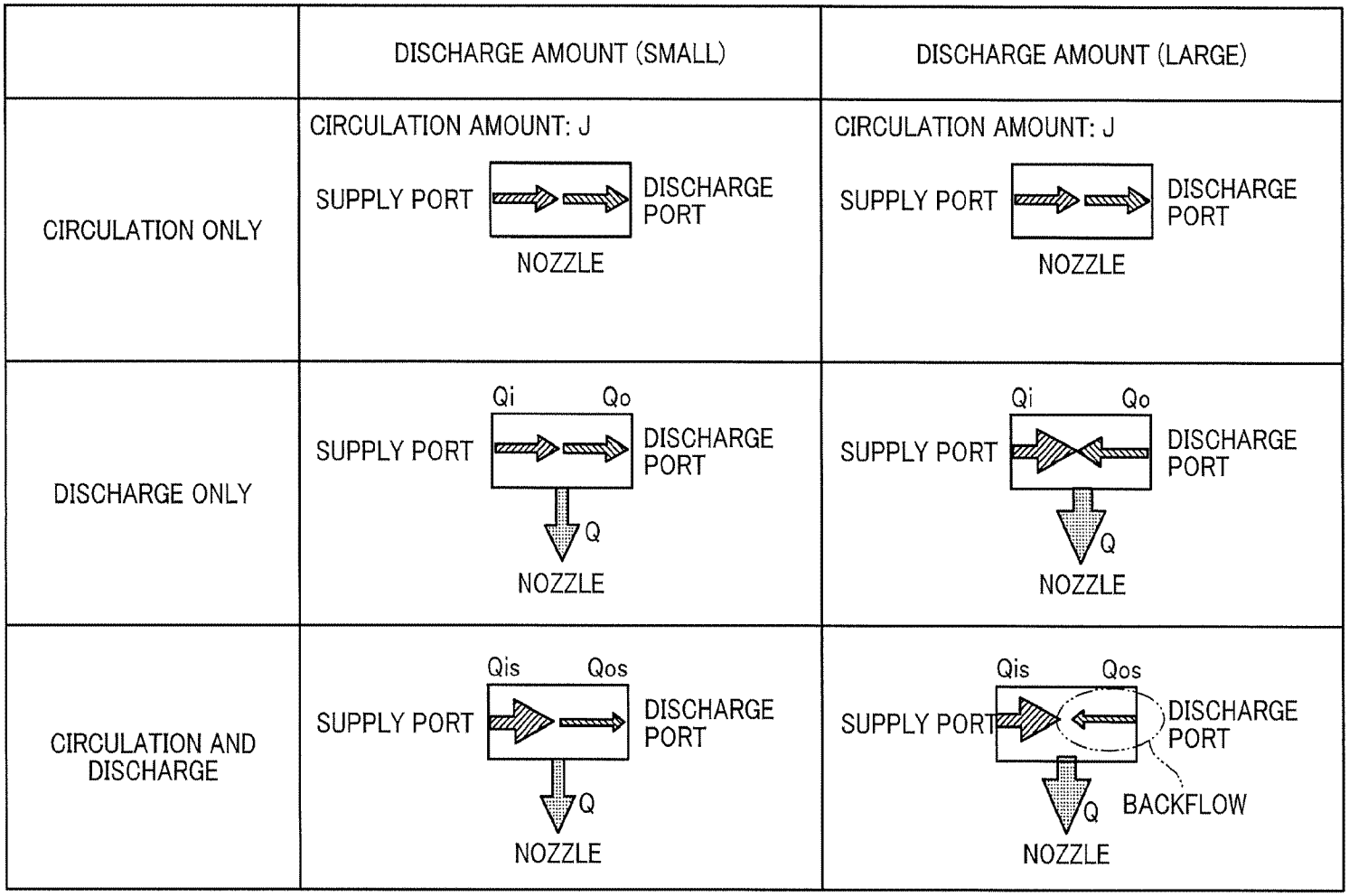
FIG. 6 is an explanatory view of a backflow phenomenon in which liquid flows backward.

Next, a backflow phenomenon in which liquid flows backward from the discharge port 172 side of the head 100 to the discharge channel is described with reference to FIG. 6. FIG. 6 is a table for explaining backflow.

With reference to FIG. 6, symbols "J", "Q", "Qi", and "Qo" indicate the following: "J" indicates a flow rate of a circulation flow only when the liquid is not discharged from the head 100. "Q" indicates a discharge amount of the liquid from the head 100 when circulation of flow is not performed and only the discharge process of the head 100 is performed. "Qi" indicates a flow rate from the supply port 171 to the nozzle 104 (to replace the discharged volume of liquid). "Qo" indicates a flow rate from the discharge port 172 to the nozzle 104 (to replace the discharged volume of liquid).

Next, with reference to FIG. 6, flow rates Qis and Qos are calculated from following equations from the above-mentioned conditions. The flow rate Qis is a flow rate from the supply port 171 to the nozzle 104 when liquid circulation and discharge operation are performed. The flow rate Qos is a flow rate from the discharge port 172 to the nozzle 104 when liquid circulation and discharge operation are performed. The flow rates Qis and Qos can be calculated by synthesis of "J", "Qi", and "Qo", thus following equations are obtained.

$$Qis=J+Qi \quad Qos=J-Qo$$

When Qos<0, that is, when J<Qo, backflow, in which the liquid flows from the discharge port 172 of the head 100 to the nozzle 104 side through the discharge channel, occurs.

Next, the flow rate Qo is described below.

As illustrated in FIG. 6, since Q=Qi+Qo, the discharge amount Q is distributed by an inverse ratio of a fluid resistance ratio of the liquid channel.

The flow rate Qi and Qo are calculated from following equations where ri is a supply-side fluid resistance, ro is a discharge-side fluid resistance, and ri:ro is a fluid resistance ratio between ri and ro.

$$Qi=ro/(ri+ro)\times Q \quad Qo=ri/(ri+ro)\times Q$$

When backflow occurs, the liquid is supplied into the head 100 not only from the supply port 171 side of the head 100 but also from the discharge port 172 side. At this time, foreign matter and air has to be removed from the liquid to be supplied (reversed) to the discharge channel inside the head 100 from the second sub tank 221 via the second manifold 251. Thus, it is preferable to provide the filter 271 and the degassing device 272 on the liquid channel through which the liquid is supplied (reversed) to the discharge channel inside the head 100 from the second sub tank 221 via the second manifold 251.

In this case, if a filter or a degassing device is provided in the liquid channel through which the liquid flows backward separately from the normal circulation channel (main channel), the configuration of the liquid circulation device 200 becomes complicated.

Thus, in the present embodiment, the decompression-side reverse channel 286 that bypasses the second liquid feed pump 203 is connected to the liquid channels 281 and 282. One end of the decompression-side reverse channel 286 is connected to the liquid channel 282 upstream from the second liquid feed pump 203, and another end of the decompression-side reverse channel 286 is connected to the liquid channel 281 downstream from the filter 271 and the degassing device 272.

Therefore, when the solenoid valve 287 of the decompression-side reverse channel 286 is opened, the liquid flowing backward to the second sub tank 221 passes through the filter 271, the degassing device 272, and the solenoid valve 287, and the foreign matter and air bubbles in the liquid are thus removed by the filter 271 and the degassing device 272. Thus, the filter 271 and the degassing device 272 are used in both a normal circulation process and a backflow (reverse flow) circulation process in the circulation channel 301.

In this way, the liquid circulation device 200 according to the present embodiment has a simple configuration by sharing the filter 271 and the degassing device 272 used in both the normal circulation process and the backflow circulation process in which the liquid flows backward from the third sub tank 231 toward the second sub tank 221 in the circulation channel 301.

Further, the liquid circulation device 200 according to the present embodiment includes the compression-side reverse channel 284 that bypasses the first liquid feed pump 202 to be connected to the liquid channel 281 and the common liquid channel 288. One end of the compression-side reverse channel 284 is connected to the liquid channel 281 downstream from the first liquid feed pump 202, and another end of the compression-side reverse channel 284 is connected to the liquid channel 281 upstream from the filter 271 and the degassing device 272.

Therefore, when the solenoid valve 285 of the compression-side reverse channel 284 is opened, the liquid flowing backward from the first sub tank 211 passes through the solenoid valve 285, the filter 271, and the degassing device 272, and the foreign matter and air bubbles in the liquid are thus removed by the filter 271 and the degassing device 272. Thus, the filter 271 and the degassing device 272 are used in both a normal circulation process and a backflow (reverse flow) circulation process in the circulation channel 301.

In this way, the liquid circulation device 200 according to the present embodiment has a simple configuration by sharing the filter 271 and the degassing device 272 used in both the normal circulation process and the backflow circulation process in which the liquid flows backward from the third sub tank 231 toward the second sub tank 221 in the circulation channel 301.

Figure 7:
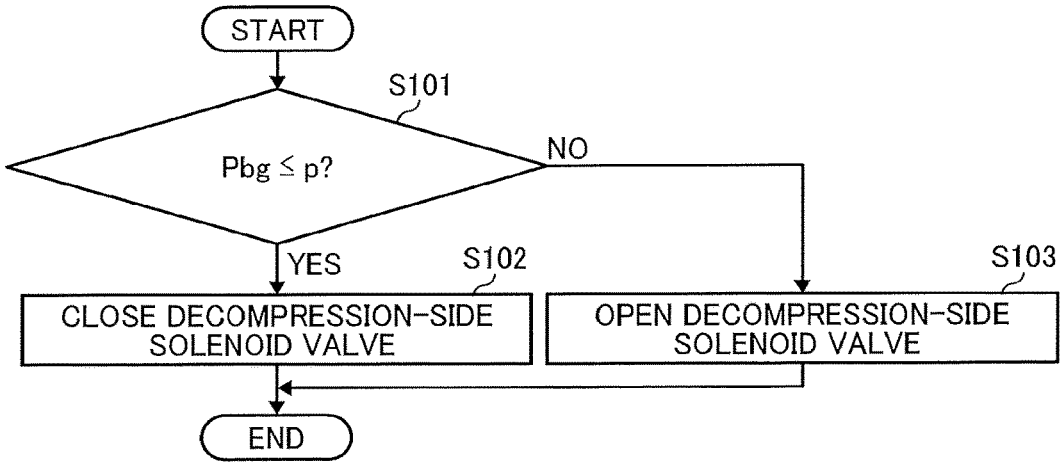
FIG. 7 is a flowchart of control of a decompression-side solenoid valve of a reverse channel.
Figure 8:
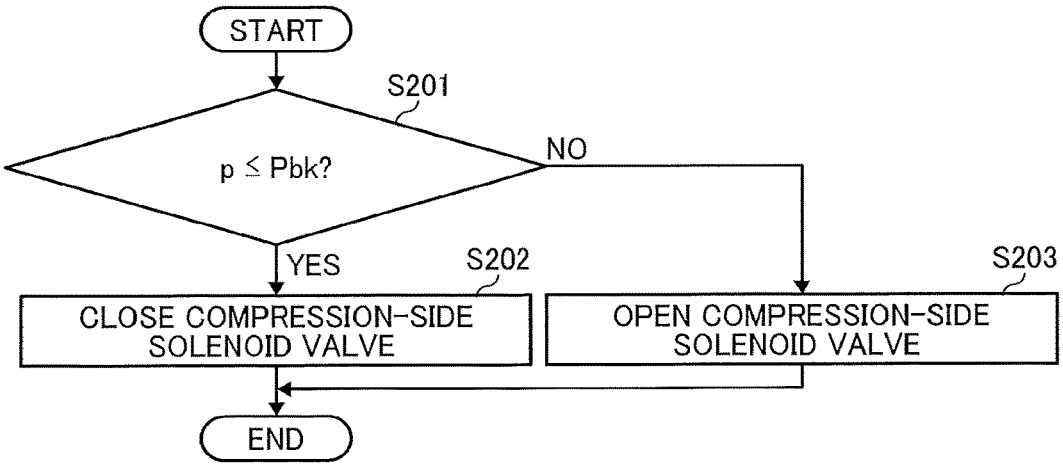
FIG. 8 is a flowchart of control of the compression-side solenoid valve.

Next, control of the solenoid valve as a valve of the reverse channel is described with reference to the flowcharts of FIGS. 7 and 8. FIG. 7 is a flowchart of control of the decompression-side solenoid valve. FIG. 8 is a flowchart of control of the compression-side solenoid valve.

When a differential pressure valve is used as a valve for opening and closing the decompression-side reverse channel 286 and the compression-side reverse channel 284, the differential pressure valve is automatically opened and closed by increase in the differential pressure. When the solenoid valves 287 and 285 are used, the solenoid valves 287 and 285 are controlled to be opened and closed as illustrated in the flowcharts of FIGS. 7 and 8, for example.

Referring to FIG. 7, when controlling the solenoid valve 287 of the decompression-side reverse channel 286, it is determined whether the pressure p of the second sub tank 221 and the second manifold 251 becomes equal to or higher than the target pressure Pbg (Pbg≤p) (S101).

Then, when the pressure p is equal to or higher than the target pressure Pbg (Pbg≤p) (YES in S101), the solenoid valve 287 is kept closed (S102). On the other hand, when the pressure p of the second sub tank 221 or the second manifold 251 is not equal to or higher than the target pressure Pbg (NO in S101), that is, the pressure P is smaller than the target pressure Pbg (Pbg>p, when the negative pressure is small), the solenoid valve 287 is opened to open the decompression-side reverse channel 286 (S103). Then, the control process ends.

Referring to FIG. 8, when controlling the solenoid valve 285 of the compression-side reverse channel 284, it is determined whether the pressure p of the first sub tank 211 or the first manifold 241 becomes equal to or less than the target pressure Pbk (p≤Pbk) (S201).

Then, when the pressure p is equal to or less than the target pressure (p≤Pbk) (YES in S201), the solenoid valve 285 is kept closed (S202). On the other hand, when the pressure p is not equal to or less than the target pressure Pbg (NO in S201), that is, the pressure P of the first sub tank 211 or the first manifold 241 is larger than the target pressure Pbg (Pbg>p, when the positive pressure is large), the solenoid valve 285 is opened to open the compression-side reverse channel 284 (S203). Then, the control process ends.

Figure 9:
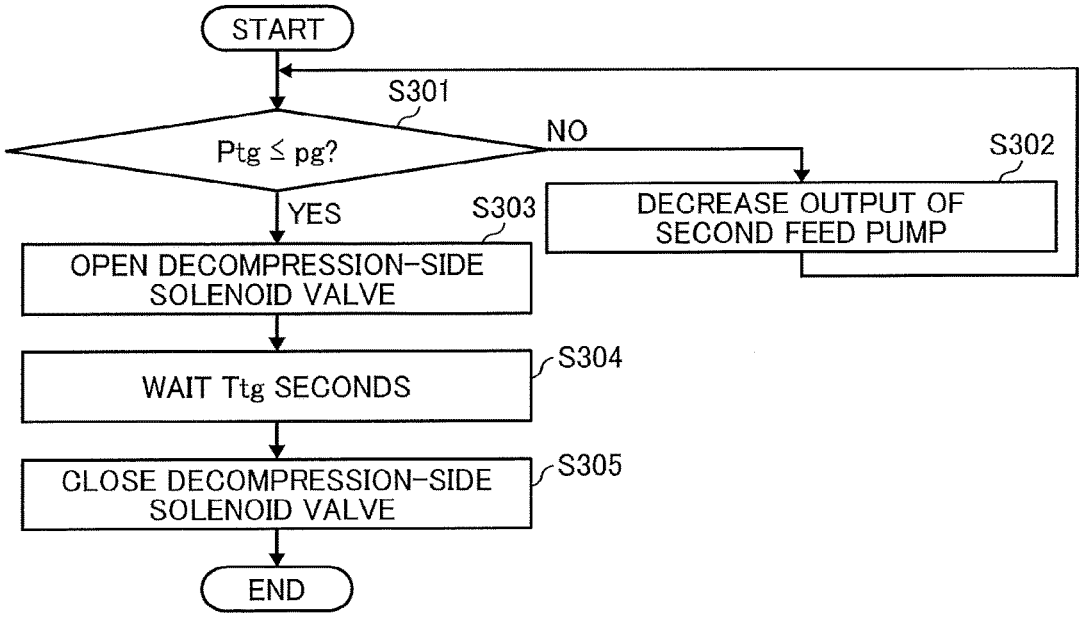
FIG. 9 is a flowchart of control of a decompression-side solenoid valve.
Figure 10:
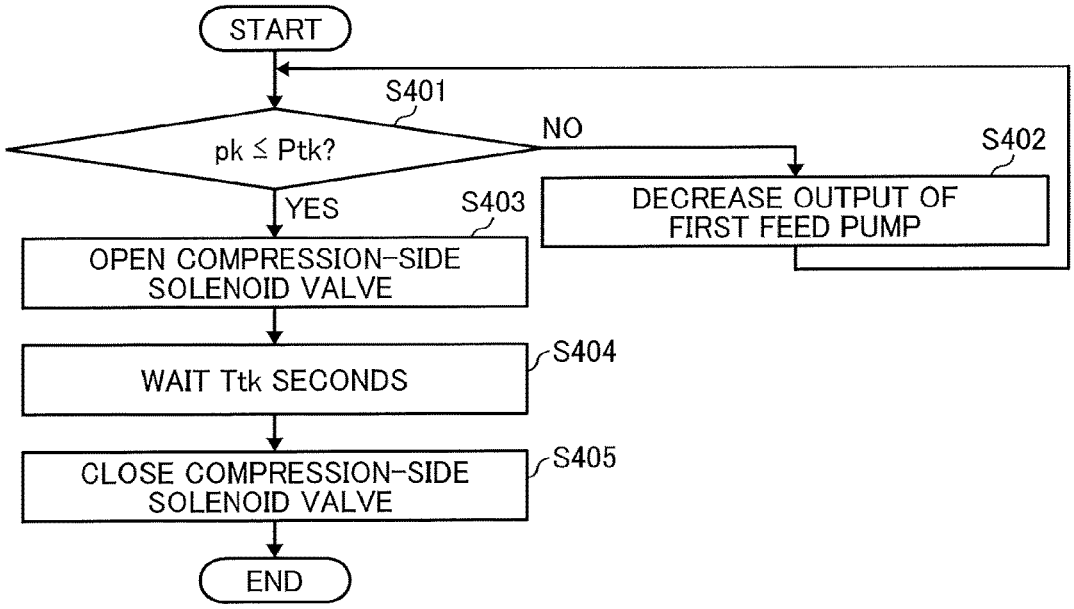
FIG. 10 is a flowchart of control of a compression-side solenoid valve.

Next, control of the solenoid valve at time of stopping the liquid circulation and applying a water head difference to the head 100 is described with reference to the flowcharts of FIGS. 9 and 10. FIG. 9 is a flowchart of control of the decompression-side solenoid valve. FIG. 10 is a flowchart of control of the compression-side solenoid valve.

Referring to FIG. 9, when the liquid circulation is stopped and the water head difference is applied to the head 100, it is determined whether the pressure pg becomes equal to or higher than the pressure Ptg (Ptg≤Pg) to control the solenoid valve 287 of the decompression-side reverse channel 286 (S301).

When the pressure pg is not equal to or higher than the pressure Ptg (Ptg≤Pg) (NO in S301), the process of decreasing the output of the second liquid feed pump 203 is repeated (S302).

On the other hand, when the pressure pg is equal to or higher than the pressure Ptg (Ptg≤Pg) (YES in S301), the solenoid valve 287 is opened to open the decompression-side reverse channel 286 (S303). Then, the solenoid valve 287 is kept open to wait until elapse of the time Ttg (S304). After the elapse of the time Ttg, the solenoid valve 287 is closed to close the decompression-side reverse channel 286 (S305). Then, the control process ends.

Referring to FIG. 10, when the liquid circulation is stopped and the water head difference is applied to the head 100, it is determined whether the pressure pk becomes equal to or less than the pressure Ptk (Pk≤Ptk) to control the solenoid valve 285 of the compression-side reverse channel 284 (S401).

When the pressure pk is not equal to or less than the pressure Ptk (Pk≤Ptk) (NO in S401), the process of decreasing the output of the first liquid feed pump 202 is repeated (S402).

On the other hand, when the pressure pk is equal to or less than the pressure Ptk (Pk≤Ptk) (YES in S401), the solenoid valve 285 is opened to open the compression-side reverse channel 284 (S403). Then, the solenoid valve 287 is kept open to wait until elapse of the time Ttk (S404). After the elapse of the time Ttk (S404), the solenoid valve 285 is closed to close the compression-side reverse channel 284 (S405). Then, the control process ends.

In this way, when the liquid circulation is stopped, the valve for opening and closing the reverse channel is temporarily opened, and the valve is closed after the lapse of a predetermined time. Thus, the liquid circulation device 200 can quickly apply the water head pressure according to the water level of the third sub tank 231 to the head 100.

Figure 11:
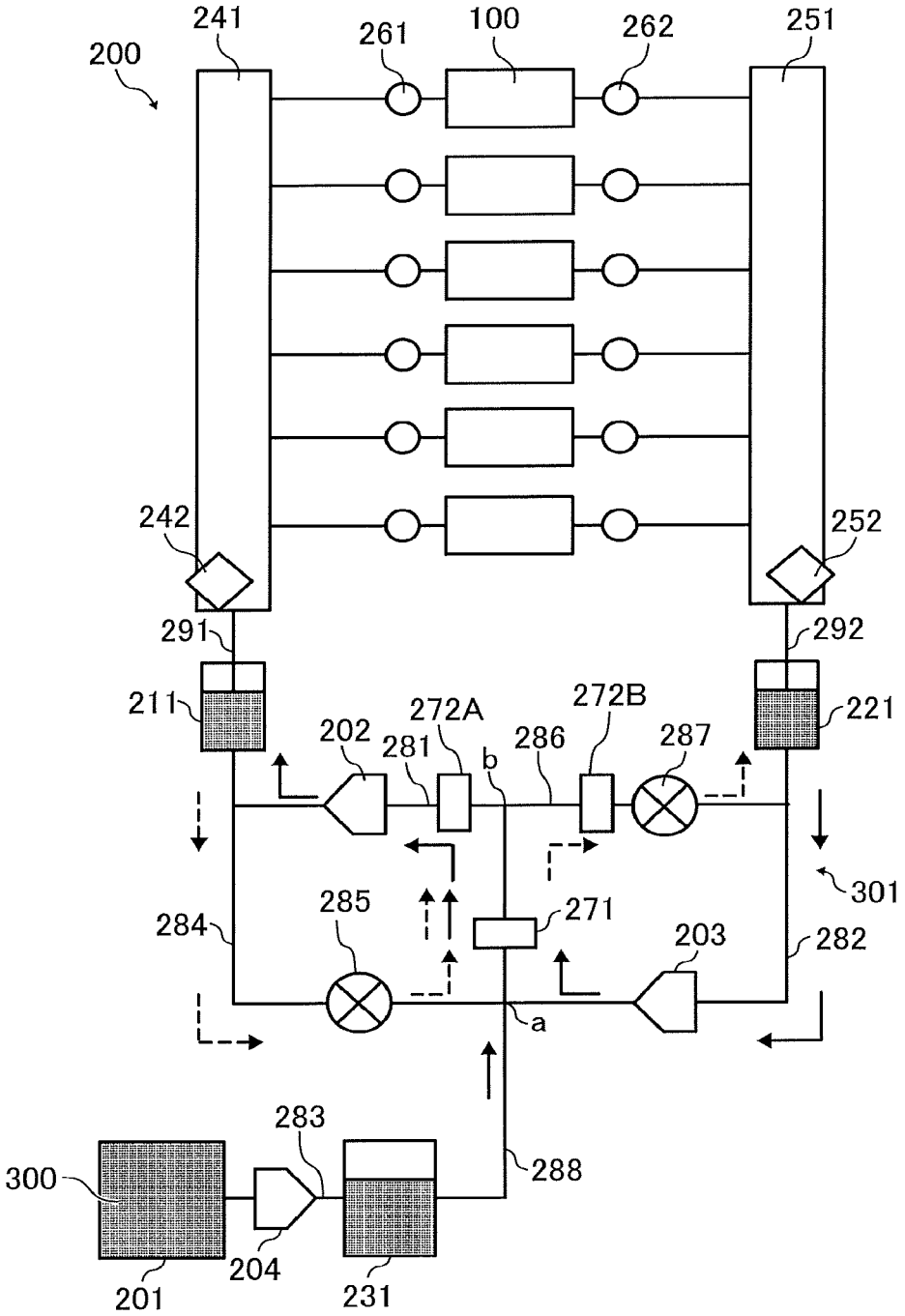
FIG. 11 is an explanatory block diagram of a liquid circulation device (liquid supply device) according to a second embodiment of the present disclosure.

A second embodiment of the present disclosure is described below with reference to FIG. 11. FIG. 11 is a block diagram of the liquid circulation device 200 (liquid supply device) according to the second embodiment.

One end of the decompression-side reverse channel 286 is connected the liquid channel 282 that connects the second liquid feed pump 203 and the second sub tank 221. Another end of the decompression-side reverse channel 286 is connected to the liquid channel 281 at a node "b". The degassing device 272A is disposed between the node "b" and the first liquid feed pump 202. The degassing device 272B is disposed between the node "b" and the solenoid valve 287. Thus, the other end of the decompression-side reverse channel 286 is connected at the node "b". The node "b" is disposed in the liquid channel 281 downstream from the filter 271 and upstream from the degassing devices 272A and 272B.

In this way, the liquid circulation device 200 according to the present embodiment has a simple configuration by sharing the filter 271 that is also used in both the normal circulation process and the backflow circulation process in the circulation channel 301.

Figure 12:
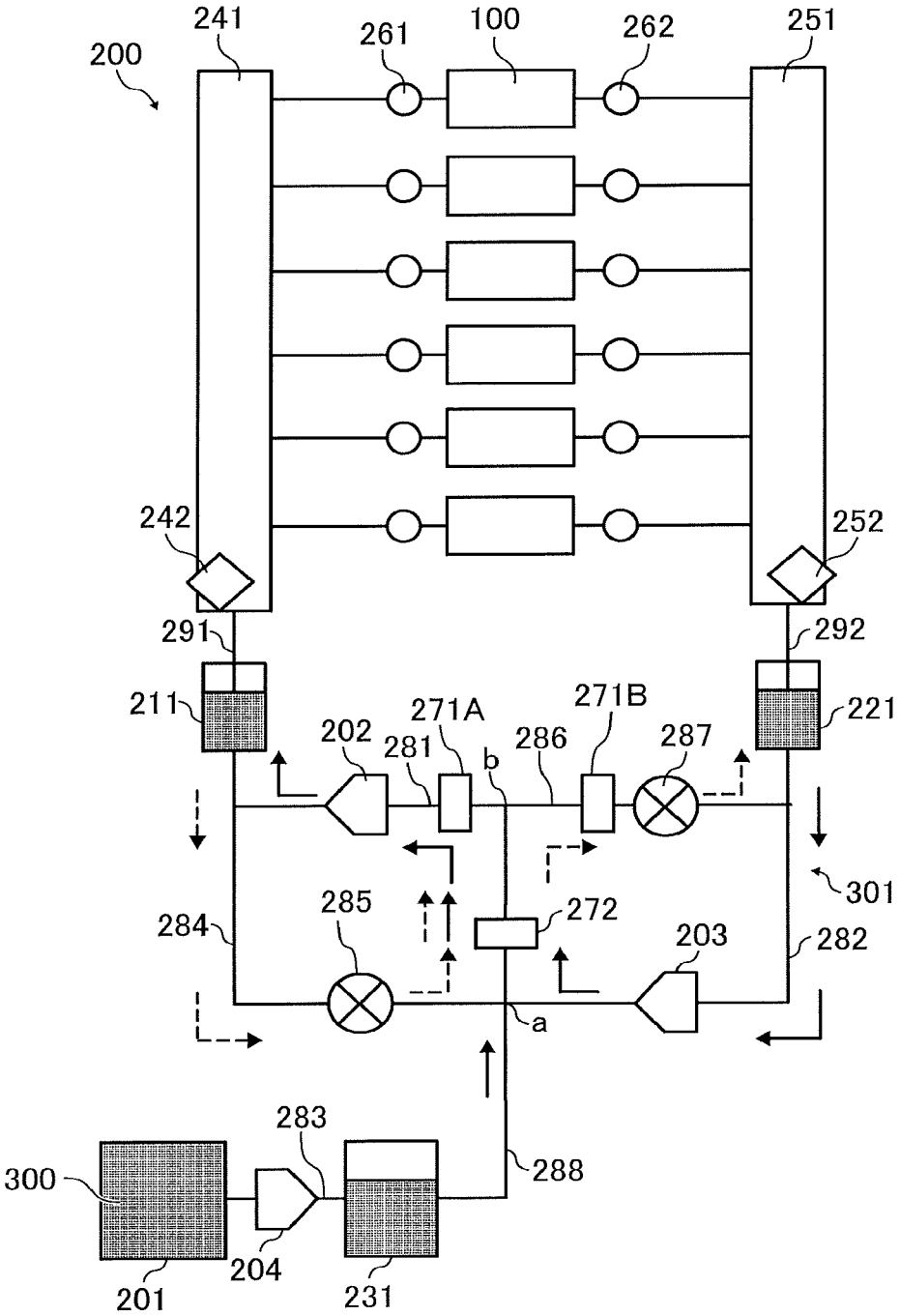
FIG. 12 is an explanatory block diagram of a liquid circulation device (liquid supply device) according to a third embodiment of the present disclosure.

A third embodiment of the present disclosure is described below with reference to FIG. 12. FIG. 12 is a block diagram of the liquid circulation device 200 (liquid supply device) according to the third embodiment.

One end of the decompression-side reverse channel 286 is connected the liquid channel 282 that connects the second liquid feed pump 203 and the second sub tank 221. Another end of the decompression-side reverse channel 286 is connected to the liquid channel 281 at a node "b". The degassing device 272 is disposed in the liquid channel 281 between the node "a" and the node "b". The filter 271A is disposed between the node "b" and the first liquid feed pump 202.

The filter 271B is disposed between the node "b" and the solenoid valve 287. Thus, the other end of the decompression-side reverse channel 286 is connected to the liquid channel 281 at the node "b". The node "b" is disposed in the liquid channel 281 upstream from the filter 271A and downstream from the degassing devices 272 in the normal circulation direction (circulation direction).

In this way, the liquid circulation device 200 according to the present embodiment has a simple configuration by sharing the degassing device 272 that is also used in the normal liquid circulation process in the circulation channel 301 when the liquid flows backward.

In the present disclosure, discharged "liquid" is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Specific examples of such liquids include, but are not limited to, solutions, suspensions, and emulsions containing solvents (e.g., water, organic solvents), colorants (e.g., dyes, pigments), functionality imparting materials (e.g., polymerizable compounds, resins, surfactants), biocompatible materials (e.g., DNA (deoxyribonucleic acid), amino acid, protein, calcium), and/or edible materials (e.g., natural colorants). Such liquids can be used as inkjet inks, surface treatment liquids, liquids for forming compositional elements of electric or luminous elements or electronic circuit resist patterns, and 3D modeling material liquids.

The "liquid discharge head" includes an energy source for generating energy to discharge liquid. Examples of the energy source include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

In the present disclosure, "liquid discharge apparatus" refers to an apparatus including a liquid discharge head or a liquid discharge unit, configured to discharge a liquid by driving the liquid discharge head. The liquid discharge apparatus may be, for example, an apparatus capable of discharging liquid onto a material to which liquid can adhere or an apparatus to discharge liquid into gas or another liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet surface with the treatment liquid to reform the sheet surface and an injection granulation apparatus to discharge a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid circulation device, comprising:

a liquid discharge head;

a circulation channel through which a liquid is circulated via the liquid discharge head;

a first liquid feed pump to supply the liquid to the liquid discharge head in a circulation direction;

a second liquid feed pump to collect the liquid from the liquid discharge head in the circulation direction;

a filter disposed in the circulation channel upstream from the first liquid feed pump and downstream from the second liquid feed pump in the circulation direction; and a decompression-side reverse channel to bypass the second liquid feed pump, wherein one end of the decompression-side reverse channel is connected to the circulation channel upstream from the second liquid feed pump, and another end of the decompression-side reverse channel is connected to the circulation channel downstream from the filter in the circulation direction.

2. The liquid circulation device according to claim 1, further comprising a compression-side reverse channel to bypass the first liquid feed pump, wherein one end of the compression-side reverse channel is connected to the circulation channel downstream from the first liquid feed pump, and another end of the compression-side reverse channel is connected to the circulation channel upstream from the filter in the circulation direction.

3. The liquid circulation device according to claim 2, further comprising a compression-side valve to open and close the compression-side reverse channel.

4. The liquid circulation device according to claim 1, further comprising a decompression-side valve to open and close the decompression-side reverse channel.

5. The liquid circulation device according to claim 1, further comprising a degassing device disposed in the circulation channel upstream from a node between the circulation channel and the another end of the decompression-side reverse channel in the circulation direction.

6. The liquid circulation device according to claim 5, further comprising a compression-side reverse channel to bypass the first liquid feed pump, wherein one end of the compression-side reverse channel is connected to the circulation channel downstream from the first liquid feed pump, and another end of the compression-side reverse channel is connected to the circulation channel upstream from the filter and the degassing device in the circulation direction.

7. The liquid circulation device according to claim 1, further comprising:

a plurality of liquid discharge heads; and a first manifold communicating with a supply port of each of the plurality of liquid discharge heads;

a second manifold communicating with a discharge port of each of the plurality of liquid discharge heads;

a first sub tank disposed between the first manifold and the first liquid feed pump, the liquid being supplied to the first manifold from the first sub tank by the first liquid feed pump; and a second sub tank disposed between the second manifold and the second liquid feed pump, the liquid being collected from the second manifold to the second sub tank by the second liquid feed pump.

8. The liquid circulation device according to claim 1, further comprising:

a main tank to store the liquid; and a third sub tank to which the liquid is supplied from the main tank, wherein the first liquid feed pump supplies the liquid in the third sub tank to the liquid discharge head, and the second liquid feed pump collects the liquid from the liquid discharge head to the third sub tank.

9. A liquid discharge apparatus comprising the liquid circulation device according to claim 1, wherein the liquid circulation device includes a plurality of liquid discharge heads.

10. A liquid circulation device, comprising:

a liquid discharge head;

a circulation channel through which a liquid is circulated via the liquid discharge head;

a first liquid feed pump to supply the liquid to the liquid discharge head in a circulation direction;

a second liquid feed pump to collect the liquid from the liquid discharge head in the circulation direction;

a degassing device disposed in the circulation channel upstream from the first liquid feed pump and downstream from the second liquid feed pump in the circulation direction; and a decompression-side reverse channel disposed outside the liquid discharge head to bypass the second liquid feed pump, wherein one end of the decompression-side reverse channel is connected to the circulation channel upstream from the second liquid feed pump, and another end of the decompression-side reverse channel is connected to the circulation channel downstream from the degassing device in the circulation direction.

11. The liquid circulation device according to claim 10, further comprising a compression-side reverse channel to bypass the first liquid feed pump, wherein one end of the compression-side reverse channel is connected to the circulation channel downstream from the first liquid feed pump, and another end of the compression-side reverse channel is connected to the circulation channel upstream from the degassing device in the circulation direction.

12. The liquid circulation device according to claim 11, wherein the compression-side reverse channel connects a first node disposed between the degassing device and the first liquid feed pump and the circulation channel upstream from the second liquid feed pump, the decompression-side reverse channel connects a second node disposed upstream from the degassing device and downstream from the second liquid feed pump and the circulation channel disposed downstream from the first liquid feed pump.

13. The liquid circulation device according to claim 12, further comprising:

a first sub tank disposed between the compression-side reverse channel and the liquid discharge head; and a second sub tank disposed between the decompression-side reverse channel and the liquid discharge head.

14. A liquid circulation device, comprising:

a liquid discharge head;

a circulation channel through which a liquid is circulated via the liquid discharge head;

a first liquid feed pump to supply the liquid to the liquid discharge head in a circulation direction;

a second liquid feed pump to collect the liquid from the liquid discharge head in the circulation direction;

a filter disposed in the circulation channel between the first liquid feed pump and the second liquid feed pump in the circulation direction; and a decompression-side reverse channel to bypass the second liquid feed pump, wherein one end of the decompression-side reverse channel is connected to the circulation channel between the liquid discharge head and the second liquid feed pump in the circulation direction, and another end of the decompression-side reverse channel is connected to the circulation channel between the filter and the first liquid feed pump in the circulation direction.

15. The liquid circulation device according to claim 14, further comprising a compression-side reverse channel to bypass the first liquid feed pump, wherein one end of the compression-side reverse channel is connected to the circulation channel between the first liquid feed pump and the liquid discharge head in the circulation direction, and another end of the compression-side reverse channel is connected to the circulation channel between the second liquid feed pump and the filter in the circulation direction.

16. A liquid discharge apparatus comprising the liquid circulation device according to claim 14, wherein the liquid circulation device includes a plurality of liquid discharge heads.

17. A liquid circulation device, comprising:

a liquid discharge head;

a circulation channel through which a liquid is circulated via the liquid discharge head;

a first liquid feed pump to supply the liquid to the liquid discharge head in a circulation direction;

a second liquid feed pump to collect the liquid from the liquid discharge head in the circulation direction;

a degassing device disposed in the circulation channel upstream from the first liquid feed pump and downstream from the second liquid feed pump in the circulation direction; and a decompression-side reverse channel disposed outside the liquid discharge head to bypass the second liquid feed pump, wherein one end of the decompression-side reverse channel is connected to the circulation channel between the liquid discharge head and the second liquid feed pump in the circulation direction, and another end of the decompression-side reverse channel is connected to the circulation channel between the degassing device and the first liquid feed pump in the circulation direction.

18. The liquid circulation device according to claim 17, further comprising a compression-side reverse channel to bypass the first liquid feed pump, wherein one end of the compression-side reverse channel is connected to the circulation channel between the first liquid feed pump and the liquid discharge head in the circulation direction, and another end of the compression-side reverse channel is connected to the circulation channel between the second liquid feed pump and the degassing device in the circulation direction.

19. A liquid discharge apparatus comprising the liquid circulation device according to claim 17, wherein the liquid circulation device includes a plurality of liquid discharge heads.

* * * * *